US012545549B2

(12) United States Patent
Kudo et al.

(10) Patent No.: US 12,545,549 B2
(45) Date of Patent: Feb. 10, 2026

(54) PRINTING APPARATUS AND METHOD OF CONTROLLING PRINTING APPARATUS

(71) Applicant: CANON KABUSHIKI KAISHA, Tokyo (JP)

(72) Inventors: Koki Kudo, Kanagawa (JP); Takashi Sasaki, Kanagawa (JP); Shuichi Tokuda, Kanagawa (JP); Yuki Emoto, Tokyo (JP); Hideyasu Ishihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 18/376,880

(22) Filed: Oct. 5, 2023

(65) Prior Publication Data

US 2024/0116727 A1 Apr. 11, 2024

(30) Foreign Application Priority Data

Oct. 6, 2022 (JP) ..... 2022-161420

(51) Int. Cl.

| | |
|---|---|
| ***B65H 85/00*** | (2006.01) |
| ***B65H 3/06*** | (2006.01) |
| ***B65H 5/06*** | (2006.01) |
| ***B65H 5/36*** | (2006.01) |
| ***B65H 7/02*** | (2006.01) |

(52) U.S. Cl.

CPC ..... *B65H 85/00* (2013.01); *B65H 3/06* (2013.01); *B65H 5/062* (2013.01); *B65H 5/36* (2013.01); *B65H 7/02* (2013.01); *B65H 2301/31124* (2013.01); *B65H 2407/21* (2013.01)

(58) Field of Classification Search

CPC . B65H 3/06; B65H 5/062; B65H 5/26; B65H 5/36; B65H 5/38; B65H 7/02; B65H 7/04; B65H 85/00; B65H 2301/31124; B65H 2404/142; B65H 2404/1421; B65H 2407/21

See application file for complete search history.

(56) References Cited

U.S. PATENT DOCUMENTS 9,827,791 B2 * 11/2017 Shinohara ..... B41J 2/01
10,792,938 B2 10/2020 Tsukuda et al.

(Continued)

FOREIGN PATENT DOCUMENTS

JP 2013-129482 A 7/2013

*Primary Examiner* — Prasad V Gokhale
(74) *Attorney, Agent, or Firm* — Venable LLP

(57) ABSTRACT

A printing apparatus includes a first path conveying a printing medium from a manual-feed stacking unit to a printing unit; a second path converging with the first path at a converging section and conveying a printing medium from a cassette; a first roller pair provided downstream of the converging section on the first path to nip and convey a printing medium; a first detection unit detecting a printing medium stacked on the manual-feed stacking unit; a second roller pair provided downstream of the first roller pair on the first path to nip and convey a printing medium; a second detection unit arranged between the first and second roller pairs to detect a printing medium; and a control unit performing control to start feeding of the printing medium to the printing unit by the first roller pair if the first detection unit detects the printing medium but the second detection unit does not.

10 Claims, 14 Drawing Sheets

(56) References Cited

U.S. PATENT DOCUMENTS

| | | | | |
|---|---|---|---|---|
| 2011/0291353 | A1* | 12/2011 | Fujiwara | B65H 9/006 271/265.01 |
| 2014/0001698 | A1* | 1/2014 | Okano | B65H 5/00 271/18 |
| 2016/0244284 | A1* | 8/2016 | Takahashi | B65H 1/04 |
| 2019/0062093 | A1* | 2/2019 | Inoue | B65H 5/062 |

* cited by examiner

PRINTING APPARATUS AND METHOD OF CONTROLLING PRINTING APPARATUS

BACKGROUND OF THE INVENTION

Field of the Invention

The present invention relates to a printing apparatus and a method of controlling the printing apparatus, and to be specific, the present invention relates to a technique to feed and convey a printing medium by manual feeding.

Description of the Related Art

In manual-feed feeding, a user sets a printing medium to a feeding unit, and feeding to a printing unit is performed from this state. Therefore, depending on how the user sets, the printing medium may be set tilted with respect to a conveyance path of the printing medium.

To deal with this, Japanese Patent Laid-Open No. 2013-129482 describes that a configuration in which a tip of a printing medium is biased to a conveyance roller in a case where the printing medium is set to a feeding unit is provided, and even if the printing medium is set tilted, feeding is performed with the tilt being solved by the biasing force. Specifically, in the printing medium set tilted, bending in accordance with the tilt is formed by the above-described biasing force. Then, with reaction force being caused by the bending, tips of the printing medium are supplied substantially simultaneously in a width direction of the printing medium to a nipping unit of a conveyance roller. Therefore, the tilt of the printing medium is solved in the following conveyance.

However, in the configuration in which the bending is formed on the printing medium to solve the tilt that is disclosed in Japanese Patent Laid-Open No. 2013-129482, for example, if the printing medium is thick paper or the like with high stiffness, there is a possibility that the bending formed on the printing medium is insufficient, and a conveyance malfunction may be caused. That is, because no bending is formed, the entirety of the printing medium in the width direction cannot be aligned and brought into contact with the nipping unit of the conveyance roller. As a result, sufficient conveyance force cannot be obtained, and the conveyance malfunction may be caused.

SUMMARY OF THE INVENTION

An object of the present invention is to provide a printing apparatus and a method of controlling the printing apparatus that can perform feeding without causing a conveyance malfunction regardless of a type of a printing medium in manual-feed feeding.

In a first aspect of the present invention, there is provided a printing apparatus having a first conveyance path on which a printing medium from a manual-feed stacking unit is conveyed to a printing unit in a conveyance direction; a second conveyance path converging with the first conveyance path at a converging section and on which a printing medium from a cassette is conveyed; a first conveyance roller pair provided downstream of the converging section in the conveyance direction of the first conveyance path and configured to nip and convey a printing medium; a first detection unit configured to detect a printing medium stacked on the manual-feed stacking unit; a second conveyance roller pair provided on a side downstream in the conveyance direction of the first conveyance roller pair on the first conveyance path and configured to nip and convey a printing medium; a second detection unit arranged between the first conveyance roller pair and the second conveyance roller pair and configured to detect a printing medium; and a control unit configured to perform control to start feeding of a printing medium to the printing unit by the first conveyance roller pair in a case where the first detection unit detects the printing medium but the second detection unit does not detect the printing medium.

In a second aspect of the present invention, there is provided a control method of a printing apparatus which has a first conveyance path on which a printing medium from a manual-feed stacking unit is conveyed to a printing unit in a conveyance direction; a second conveyance path converging with the first conveyance path at a converging section and on which a printing medium from a cassette is conveyed; a first conveyance roller pair provided downstream of the converging section in the conveyance direction of the first conveyance path and configured to nip and convey a printing medium; a first detection unit configured to detect a printing medium stacked on the manual-feed stacking unit; a second conveyance roller pair provided on a side downstream in the conveyance direction of the first conveyance roller pair on the first conveyance path and configured to nip and convey a printing medium; and a second detection unit arranged between the first conveyance roller pair and the second conveyance roller pair and configured to detect a printing medium, wherein control is performed to start feeding of a printing medium to the printing unit by the first conveyance roller pair in a case where the first detection unit detects the printing medium but the second detection unit does not detect the printing medium.

Further features of the present invention will become apparent from the following description of exemplary embodiments with reference to the attached drawings.

DESCRIPTION OF THE EMBODIMENTS

Figure 1:
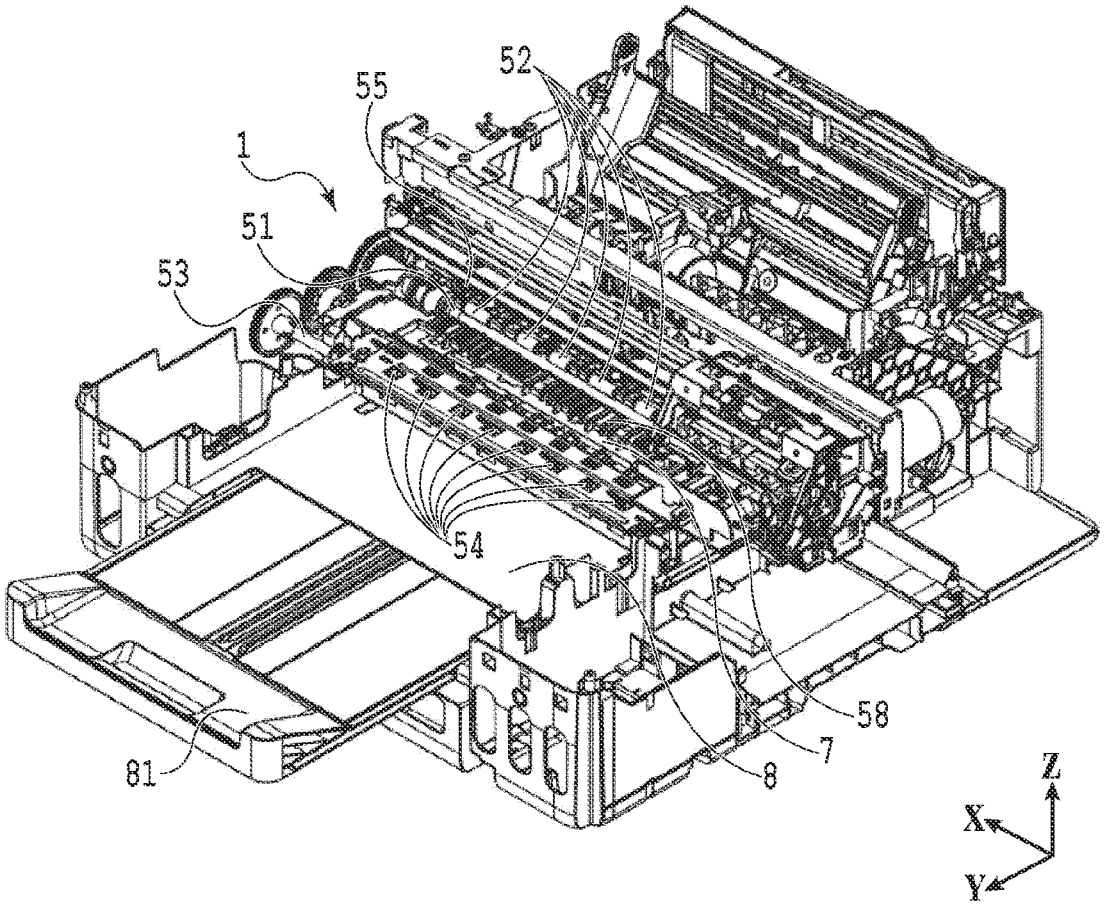
FIG. 1 is a perspective view illustrating a printing apparatus according to an embodiment of the present invention.

An embodiment of the present invention is described below in detail with reference to the appended drawings. Note that, in the appended drawings, the same or similar elements are denoted by the same reference numeral, and a duplicated description may be omitted.

Note that, "printing" indicates not only a case of forming significant information such as a character and a graphic but also a case of forming on a printing medium a wide variety of images, designs, patterns, and the like including something actualized such that a human can perceive with a sense of vision, or a case of processing the printing medium.

Additionally, "printing medium (printing paper)" includes not only common printing paper used in an image formation apparatus but also a wide variety of conveyable printing media such as cloth, plastic film (OHP), metallic plate, glass, ceramics, wooden material, and leather.

(Configuration for Printing Medium Conveyance)

Figure 2:
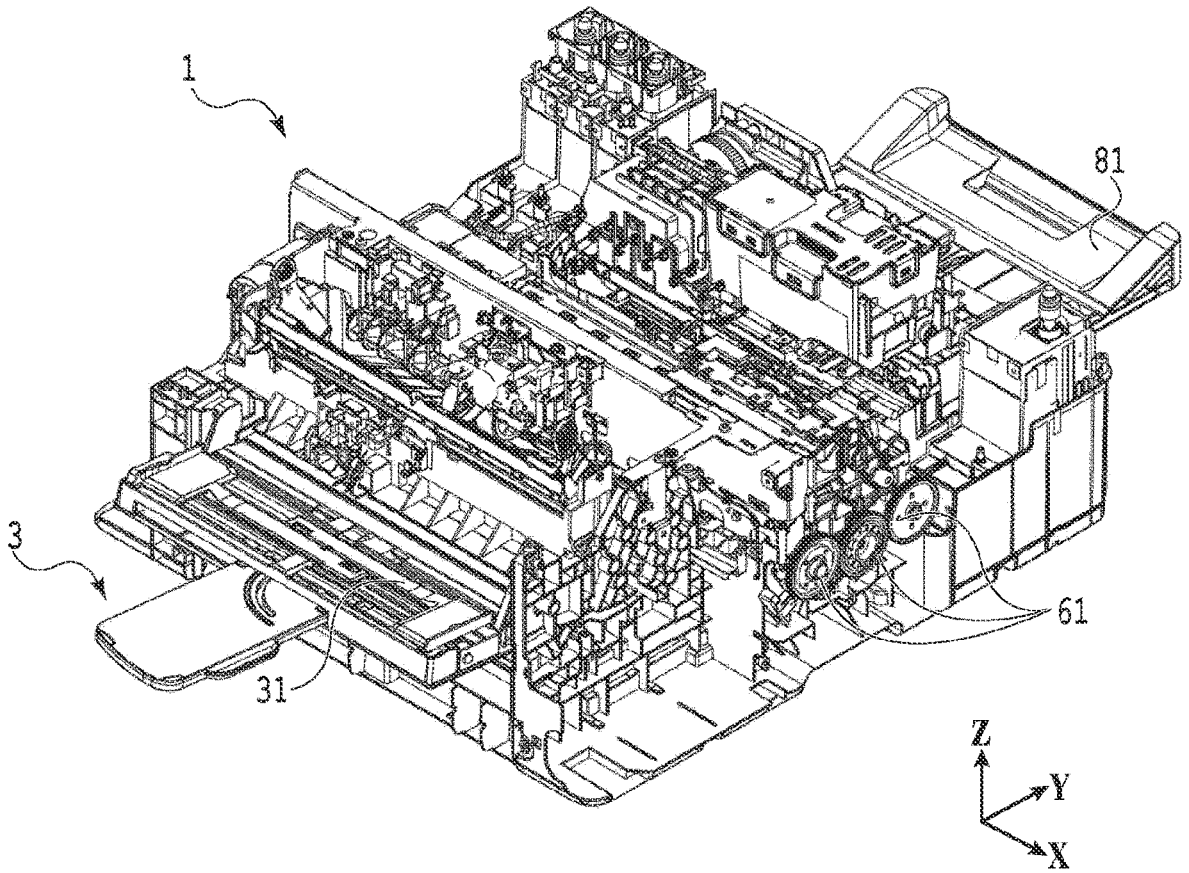
FIG. 2 is a perspective view of the printing apparatus illustrated in FIG. 1 that is viewed from a side opposite to the side in FIG. 1 (a back side of the apparatus)
Figure 3:
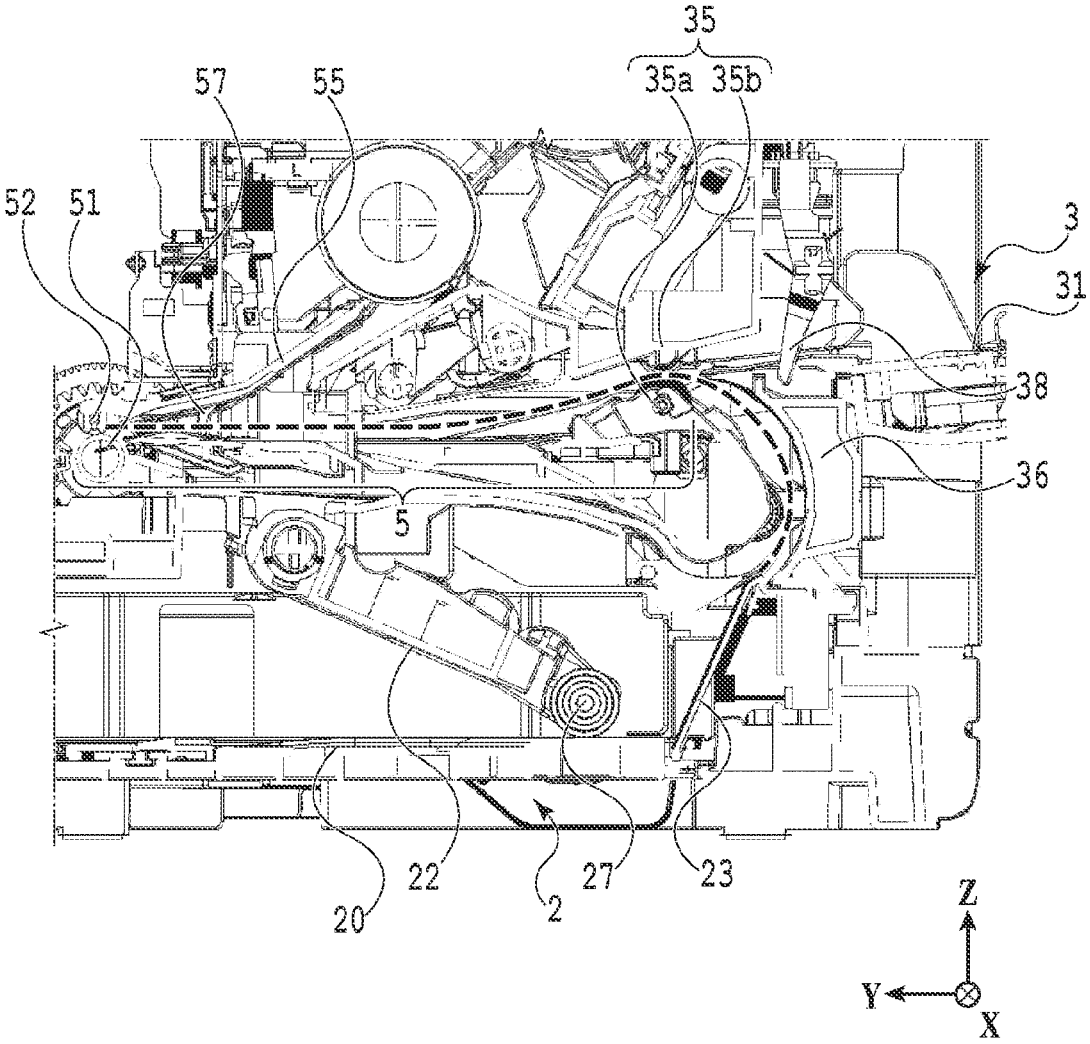
FIG. 3 is a cross-sectional view describing a printing medium conveyance path from each of a cassette feeding unit and manual-feed feeding unit in the printing apparatus illustrated in FIG. 1.

FIG. 1 is a perspective view illustrating a printing apparatus according to an embodiment of the present invention and illustrates a view from a side on which a user is usually positioned in a case of using the printing apparatus. FIG. 2 is a perspective view of the printing apparatus illustrated in FIG. 1 that is viewed from a side opposite of the side in FIG. 1 (a back side of the apparatus). FIG. 3 is a cross-sectional view describing a printing medium conveyance path from each of a cassette feeding unit and a manual-feed feeding unit in the printing apparatus in FIG. 1 and illustrates a cross-section of a part of the apparatus.

A printing apparatus 1 includes a cassette feeding unit 2 and a manual-feed feeding unit 3, a conveyance unit 5, and a discharging unit 8 as a mechanism to convey a printing medium. The cassette feeding unit 2 performs feeding by separating multiple printing media laminated in a cassette 20 one by one. The manual-feed feeding unit 3 performs feeding with the user taking one printing medium and setting to the manual-feed feeding unit 3. The conveyance unit 5 includes a roller and the like provided along a conveyance path of the printing medium and conveys the printing medium. The discharging unit 8 discharges and stacks the printing medium on which printing is performed by a printing unit 7 provided to a part of the conveyance path in the conveyance unit 5.

More specifically, as illustrated in FIG. 3, the cassette feeding unit 2 includes the cassette 20 on which the printing media are stacked, a pickup roller unit 22, and a separation unit 23 that separates the top one of the stacked printing media from the other printing media so as to feed only the topmost printing medium. Some of the top of the laminated printing media stacked on the cassette 20 are brought into contact with the separation unit 23 by rotation of a pickup roller 27 attached to the pickup roller unit 22. Thus, the top one of such printing media is separated and is fed to the conveyance path in the conveyance unit 5.

The manual-feed feeding unit 3 includes a manual-feed stacking unit 31 on which the printing medium is placed to set the printing medium. The printing medium is placed on the manual-feed stacking unit 31 including a feeding port at an end portion while being nipped by an intermediate roller pair 35 (a first conveyance roller pair) by a later-described setting method. A conveyance path formed in the manual-feed stacking unit 31 converges with the conveyance path in the conveyance unit 5 upstream of the intermediate roller pair 35 with respect to a conveyance direction, and thus the printing medium fed from the manual-feed feeding unit 3 is conveyed by the intermediate roller pair 35 through the conveyance path in the conveyance unit 5.

The conveyance unit 5 includes the intermediate roller pair 35, a conveyance roller 51 and a pinch roller 52 facing the conveyance roller 51, and a discharging roller 53 and a spur 54 facing the discharging roller 53.

To be specific, the intermediate roller pair 35 is formed of an intermediate roller 35*b* and an association roller 35*a*, and the printing medium is conveyed with the printing medium nipped by the association roller 35*a* being pressed onto the intermediate roller 35*b* while the intermediate roller 35*b* rotates. In the cassette feeding, the intermediate roller pair 35 functions as an intermediate roller playing a role of a relaying unit that conveys the printing medium in the middle of the conveyance path from the pickup roller 27 of the cassette feeding unit 2 to the conveyance roller 51 and the pinch roller 52 (a second conveyance roller pair). Additionally, in the manual-feed feeding, the intermediate roller pair 35 functions as a feeding roller that conveys the nipped printing medium to the conveyance roller 51 and the pinch roller 52. Thus, since the intermediate roller playing a role of the relaying unit in the cassette feeding is also used as the feeding roller in the manual-feed feeding, there is caused no increase in cost due to an increase in a size of the apparatus and an increase in the number of parts. Additionally, the feeding port provided in the back side makes it possible to start the manual-feed feeding without cumbersome work before the printing, and it is possible to achieve both the feeding of the printing medium with high operability and the feeding with high performance of treating the printing medium.

The discharging unit 8 includes a discharging tray 81 on which the printing medium discharged by the discharging roller 53 is stacked.

The printing medium fed from the cassette feeding unit 2 or the manual-feed feeding unit 3 to the conveyance unit 5 is nipped between the pinch roller 52 and the conveyance roller 51 pivotally held by a pinch roller holder 55. With this, the printing medium is conveyed to the printing unit 7 with the pinch roller 52 applying biasing force to the conveyance roller 51 and also the conveyance roller 51 rotating. According to printing data, ink is ejected from a nozzle of a not-illustrated printing head onto the printing medium conveyed to the printing unit 7, and thus an image and the like are printed. The printing unit 7 can perform the printing in a region in a width direction of the printing medium with the printing head moving in a scanning direction in FIG. 1 (X direction). The printing medium on which the printing is performed by the printing unit 7 is nipped by the discharging roller 53 and the spur 54 and discharged to the discharging tray 81.

Rotational driving force generated by a driving motor (not illustrated) as a driving source is transmitted to the conveyance roller 51, the discharging roller 53, the intermediate roller 35*b*, and the pickup roller 27 through a gear train 61 and can pivot each roller Note that, a driving direction in which the driving motor rotates the conveyance roller 51 in a direction of conveying the printing medium to a side downstream in the conveyance direction is referred to as a forward direction, and a driving direction in which the driving motor rotates the conveyance roller in a direction of conveying the printing medium to a side upstream in the conveyance direction is referred to as a backward direction.

Between the cassette feeding unit 2 and the conveyance unit 5 in the conveyance direction, the pinch roller holder 55 is arranged on an upper side of FIG. 1, and a guide portion is arranged on a lower side, such that the pinch roller holder 55 and the guide portion each guide the conveyed printing medium. Additionally, between the conveyance roller 51 and the discharging roller 53 in the conveyance direction, a platen 58 is arranged on the lower side in FIG. 1, and the platen 58 guides the printing medium so as to keep a constant distance between the printing medium conveyed to the printing unit 7 and the nozzle.

(Cassette Feeding Unit)

Figure 4:
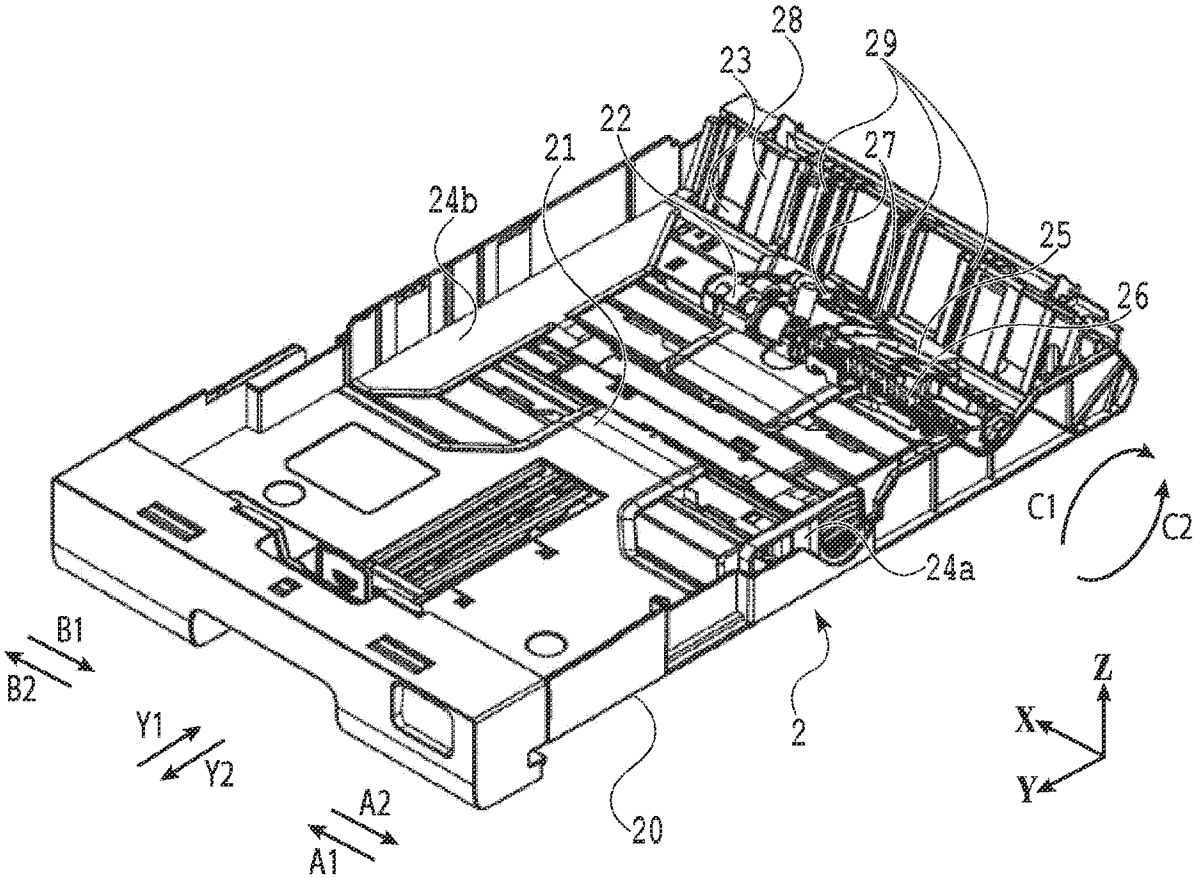
FIG. 4 is a perspective view illustrating details of the cassette feeding unit according to the embodiment.

FIG. 4 is a perspective view illustrating details of the cassette feeding unit 2. The cassette feeding unit 2 includes the cassette 20 in the form of a substantially cuboid box, and an element forming the cassette feeding unit 2 is provided inside the cassette 20. To be specific, in the cassette 20, a cassette stacking unit 21 in which the laminated multiple printing media can be stored, the pickup roller unit 22 that picks up the printing medium, and the separation unit 23 that separates the multiple printing media one by one are provided.

In the cassette stacking unit 21, a pair of right and left cassette side guides (guide members) 24*a* and 24*b* that guide side portions of the printing medium in the width direction is provided to align the right and left positions of the sides of the printing medium. The positions of the cassette side guides 24*a* and 24*b* can be adjusted in accordance with a width of the printing medium, and the cassette side guides 24*a* and 24*b* are formed to face the two side portions of the printing medium, move in conjunction with each other in directions of arrows A1 and B1 to be close to each other, and move in conjunction with each other in directions of arrows A2 and B2 to be away from each other. Thus, the printing medium is arranged such that the center thereof in the width direction (the X direction in FIG. 4) is kept in a given position. Additionally, the cassette 20 is formed such that the cassette 20 can be moved in directions of arrows Y1 and Y2 with respect to a main body of the printing apparatus 1, and thus the user can mount and draw out the cassette 20. The printing medium is stacked (set) in a state of drawn out the most in the Y1 direction. The pickup roller unit 22 arranged above the cassette stacking unit 21 includes a pickup arm 25 and a pickup shaft 26. The pickup arm 25 can be rotated in directions of arrows C1 and C2 about the pickup shaft 26 in accordance with a stacking height of the printing media stacked on the cassette stacking unit 21. The pickup roller 27 that feeds the topmost printing medium is provided at a tip of the pickup arm 25. Driving force from a not-illustrated driving motor 6 is transmitted to the pickup roller 27 through the pickup shaft 26 and a not-illustrated idle gear. A not-illustrated biasing member that biases the pickup arm 25 in the arrow C1 direction is provided to the pickup arm 25, and in a standby state of the pickup roller unit 22, the pickup roller 27 is pressed onto the printing medium by predetermined biasing force. The pickup roller 27 is positioned in the center of the printing medium in the width direction so as to be put in contact with the printing medium.

Additionally, in the cassette stacking unit 21, the separation unit 23 that separates the multiple printing media laminated on the cassette stacking unit 21 one by one is arranged on a side downstream in a feeding direction of the printing medium (an arrow Y1 side). In the separation unit 23, an inclined surface member 28 and a separation strip 29 are provided. On the inclined surface member 28, an inclined surface forming an obtuse angle with respect to the feeding direction of the printing medium (the arrow Y1 direction) is formed so as to apply predetermined separation resistance force to the printing medium.

(Manual-Feed Feeding Unit)

Figure 5:
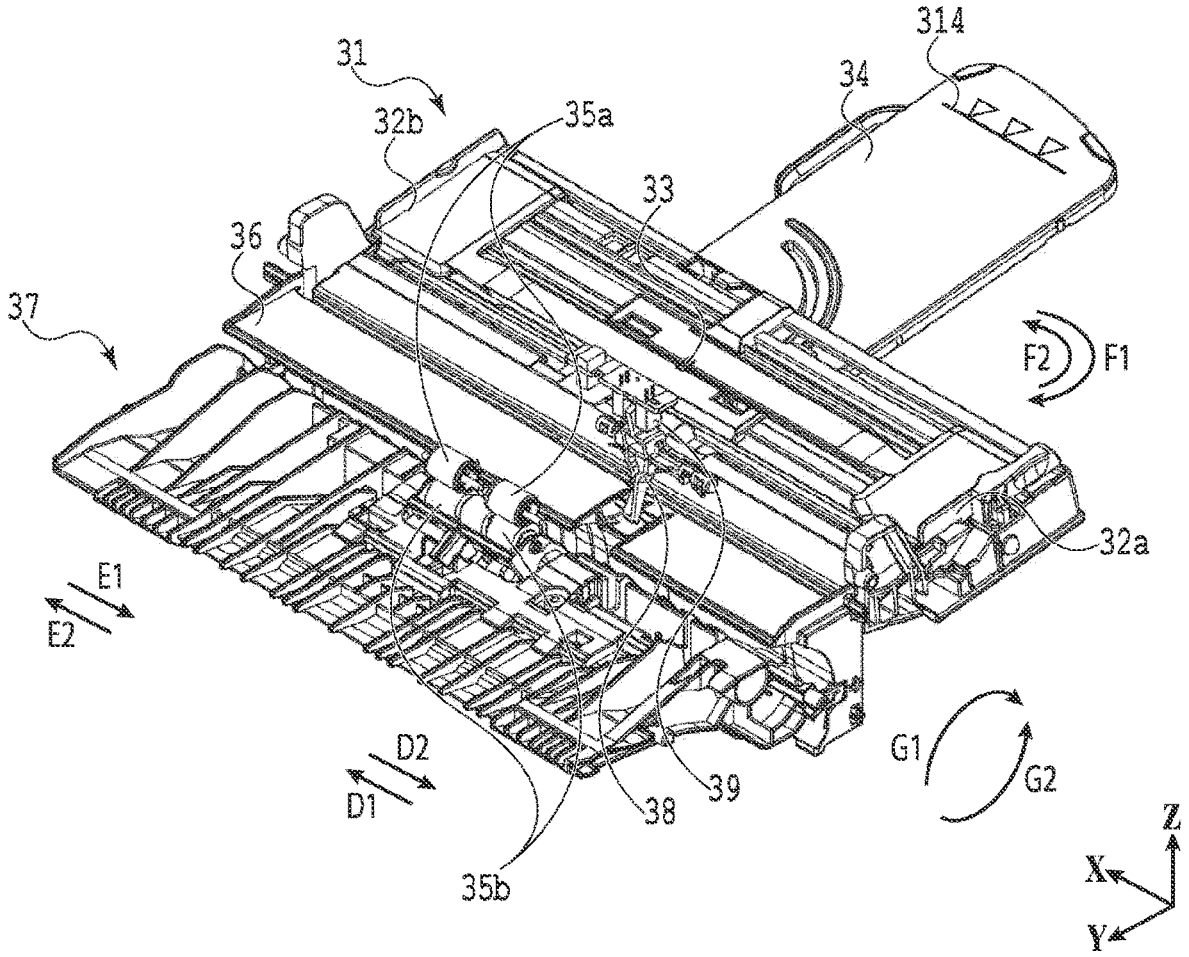
FIG. 5 is a perspective view illustrating a configuration of the manual-feed feeding unit according to the embodiment.

FIG. 5 is a perspective view illustrating a configuration of the manual-feed feeding unit. The manual-feed feeding unit 3 mainly includes units such as the manual-feed stacking unit 31 on which the printing medium can be stacked, a back side guide 36, and a conveyance guiding unit 37 including the intermediate roller pair 35.

In the manual-feed stacking unit 31, a pair of right and left manual-feed side guides (guide members) 32*a* and 32*b* that guide the positions of the side portions of the printing medium in the width direction is provided, and the manual-feed side guides 32*a* and 32*b* determine the positions of the right and left sides of the printing medium. The positions of the manual-feed side guides 32*a* and 32*b* can be adjusted in accordance with a width of the printing medium, and the manual-feed side guides 32*a* and 32*b* are formed to face the two side portions of the printing medium, move in conjunction with each other in directions of arrows D1 and E1 to be close to each other, and move in conjunction with each other in directions of arrows D2 and E2 to be away from each other. Thus, the printing medium is arranged such that the center thereof in the width direction (the X direction in FIG. 5) is kept in a given position. Additionally, the manual-feed stacking unit 31 includes a main tray unit 33 and a sub tray 34. The sub tray 34 can pivot in the F1 and F2 directions, and in the manual-feed feeding, it is possible to draw out the sub tray 34 with a pivot in the F2 direction. Additionally, on the sub tray 34, a rear end position instruction portion 314 that is a printed or stamped index is formed. This makes it possible to set the printing medium in a proper position as described later with reference to FIG. 14 by aligning a rear end of the printing medium with the rear end position instruction portion 314 during the setting of the printing medium on the manual-feed stacking unit 31. In a case where the manual-feed feeding is not performed, the sub tray 34 can pivot in the F1 direction so as to be stored in the main tray unit 33. Additionally, the manual-feed stacking unit 31 itself is also formed to pivot in G1 and G2 directions, and it is possible to store or draw out to use the manual-feed stacking unit 31 into and from the apparatus main body.

The back side guide 36 forms a U-turn shaped conveyance path guiding the printing medium to the conveyance unit 5 through a converging section during the cassette feeding on the back side of the printing apparatus. Additionally, a top surface of the back side guide 36 forms a part of the conveyance path guiding the printing medium to the conveyance unit 5 during the manual-feed feeding. The back side guide 36 can be attached to and detached from the printing apparatus 1 main body. In a case where the printing medium is jammed during the conveyance, the back side guide 36 can be detached from the printing apparatus 1 and allow the user to access the jammed printing medium. On the conveyance path formed on the top surface of the back side guide 36, a manual-feed detection sensor lever 38 and a manual-feed detection sensor 39 (a first detection unit) are provided to detect the attachment state of the back side guide 36 with respect to the apparatus main body and whether there is the printing medium on the manual-feed stacking unit 31 (first detection). The manual-feed detection sensor lever 38 is pivotally attached, and as described later with reference to FIG. 6, a light-blocking state of the manual-feed detection sensor 39 differs depending on three pivoting positions of the manual-feed detection sensor lever 38.

The intermediate roller pair 35 is provided to the conveyance guiding unit 37. The intermediate roller pair 35 includes the intermediate roller 35*b* to which the driving force is transmitted through a not-illustrated drive transmission mechanism from the driving motor and the association roller 35*a* pivotally supported by a spring shaft and rotated in association with the rotation of the intermediate roller 35*b*. Additionally, the conveyance guiding unit 37 forms a part of the conveyance path in the cassette feeding, the manual-feed feeding, and double-sided printing.

Figure 6A:
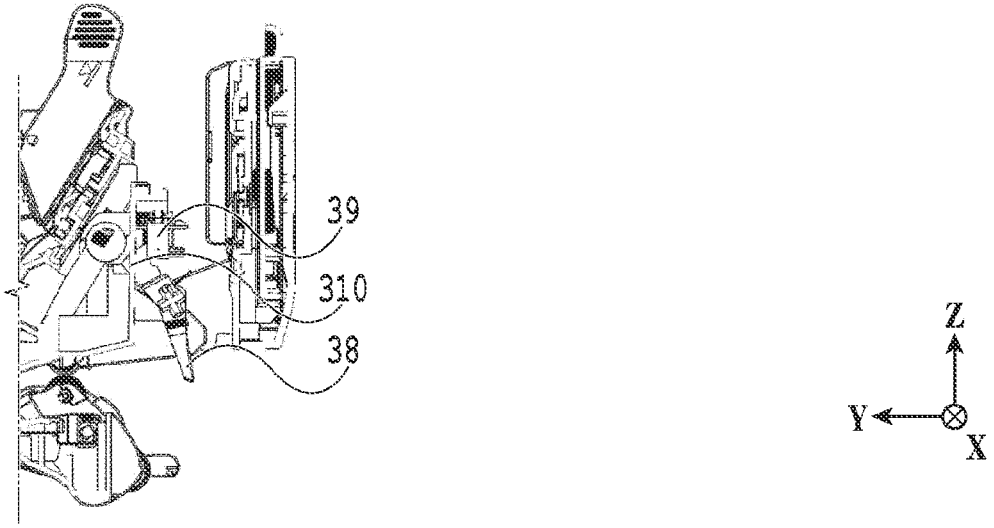
FIGS. 6A, 6B, and 6C are cross-sectional views each describing a detection state of a manual-feed detection sensor according to the embodiment.
Figure 6B:
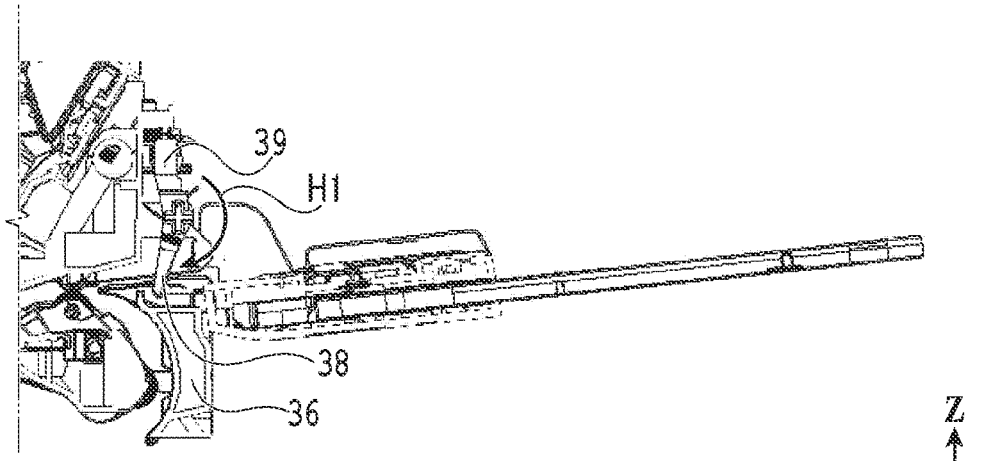
Figure 6C:
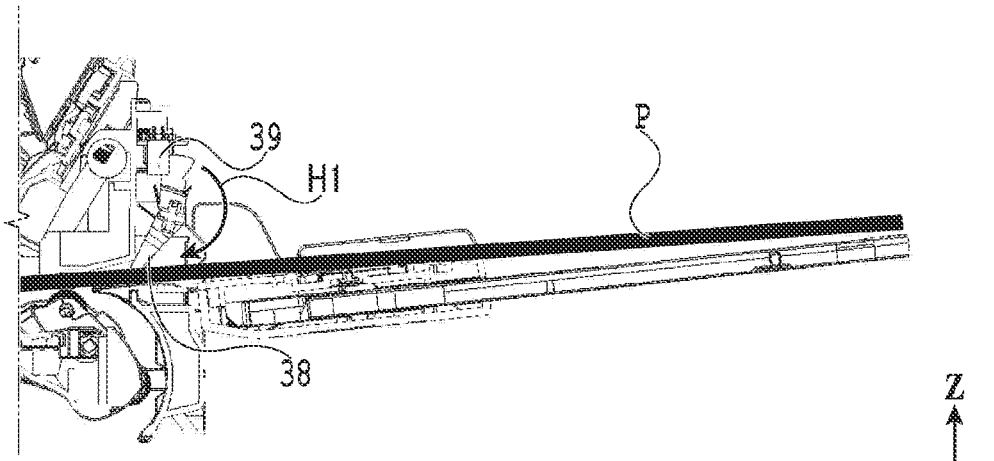

FIGS. 6A, 6B, and 6C are cross-sectional views each describing a detection state of the manual-feed detection sensor. In FIGS. 6A, 6B, and 6C, the manual-feed detection sensor lever 38 is constantly biased by a not-illustrated mechanism in a counter-clockwise direction.

FIG. 6A illustrates a state in which the back side guide 36 is not mounted. One end of the manual-feed detection sensor lever 38 is put in contact with a base member 310 by the above-described biasing force, and the light onto the manual-feed detection sensor 39 is not blocked (a detection OFF state). FIG. 6B illustrates a state in which the back side guide 36 is mounted, and there is no printing medium on the manual-feed stacking unit 31. In this state, the manual-feed detection sensor lever 38 pivots in an H1 (clockwise) direction while being put in contact with the back side guide 36 along with the mounting of the back side guide 36. Then, with the completion of the mounting of the back side guide 36, the manual-feed detection sensor lever 38 is brought into contact with the back side guide 36 (by the biasing force), and the position is maintained. In this position, the manual-feed detection sensor lever 38 blocks the light onto the manual-feed detection sensor 39 (a detection ON state). FIG. 6C illustrates a state in which the back side guide 36 is mounted, and there is a printing medium P on the manual-feed stacking unit 31. The manual-feed detection sensor lever 38 further pivots in the H1 direction from the position in FIG. 6B while being put in contact with the printing medium along with the insertion of the printing medium. Then, with the completion of the setting of the printing medium, the manual-feed detection sensor lever 38 is brought into contact with the printing medium (by the biasing force), and the position is maintained. In this position, the manual-feed detection sensor lever 38 does not block the light onto the manual-feed detection sensor 39 (the detection OFF state). In this state illustrated in FIG. 6C, the printing medium is in a state of being nipped by the intermediate roller pair 35. That is, the amount of the pivoting of the manual-feed detection sensor lever 38 that does not block the light onto the manual-feed detection sensor 39 is achieved by nipping the printing medium with the intermediate roller pair 35.

Figure 7:
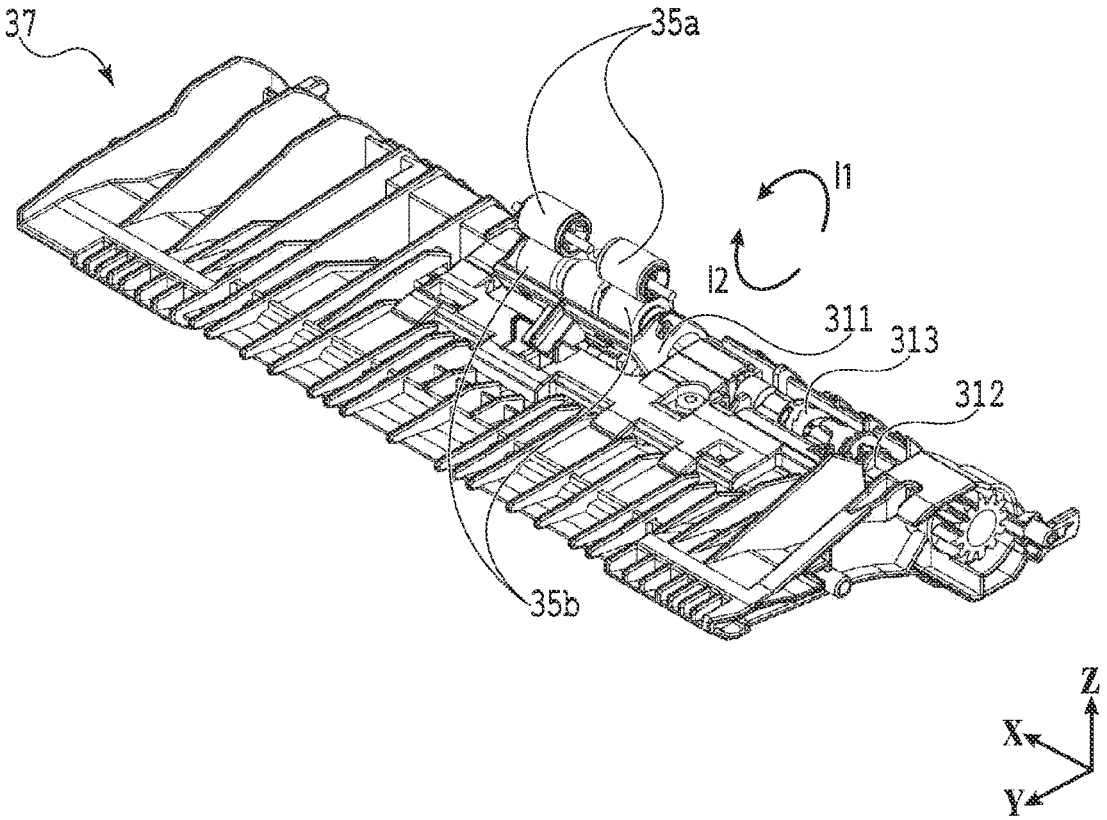
FIG. 7 is a perspective view illustrating a configuration of a conveyance guiding unit in the printing apparatus according to the embodiment.

FIG. 7 is a perspective view illustrating a configuration of the conveyance guiding unit 37, The intermediate roller pair 35 is pivotally supported at an end portion of a swing arm 311. The driving force is transmitted from the driving motor to the intermediate roller 35*b* through the not-illustrated drive transmission mechanism and a shaft unit 312. The shaft unit 312 includes a driving force interruption mechanism 313 and transmits the driving force from the driving motor in only an I1 direction in FIG. 7 but does not transmit the driving force in an I2 direction in FIG. 7. Additionally, the driving force interruption mechanism 313 interrupts the transmission of the pivoting of the intermediate roller 35*b* in the I1 direction to the shaft unit 312 and allows the intermediate roller 35*b* to pivot in the I1 direction. Thus, in the manual-feed feeding, in a case of inserting and setting the printing medium into a nipping unit of the intermediate roller pair 35, it is possible to insert the printing medium with light force into the intermediate roller pair 35.

The swing arm 311 can pivot about the shaft unit 312 and is biased in the I2 direction in FIG. 7 to bring the intermediate roller 35*b* and the association roller 35*a* into contact with each other with pressing force. In a case where the driving force is transmitted to the intermediate roller 35*b*, the swing arm 311 pivots in the I2 direction. In other words, the intermediate roller 35*b* is rotated in a direction to dig into the association roller 35*a*, and conveyance force is increased. On the other hand, in the setting of the manual-feed feeding, in a case of inserting the printing medium into the intermediate roller pair 35, the swing arm 311 pivots in the I1 direction. Since the intermediate roller 35*b* is rotated in a direction opposite to the direction to dig into the association roller 35*a*, in other words, a direction in which the nipping force by the intermediate roller pair is reduced, the conveyance force is not increased. As to the foregoing, with the intermediate roller 35*b* being held by the pivoting swing arm 311, it is possible to suppress resistance force generated in a case where the printing medium is inserted into the intermediate roller pair 35 while securing the conveyance force during the feeding and the conveyance by the intermediate roller pair 35. As a result, it is possible to improve the performance of setting the printing medium in the manual-feed feeding.

As to the foregoing, with the provision of the driving force interruption mechanism 313 and the swing arm 311 gripping the intermediate roller 35*b*, it is possible to suppress the resistance force generated in a case of inserting the printing medium between the rollers of the intermediate roller pair 35 put in contact with each other. Thus, without causing an increase in cost due to provision of a mechanism that makes the pair of rollers move away from each other and brings them into contact with each other again, it is possible to implement the manual-feed feeding that suppresses the conveyance malfunction and the complication in the apparatus in the configuration of bringing the printing medium into contact with the roller to perform feeding.

(Conveyance Unit and Conveyance Path)

Figure 8:
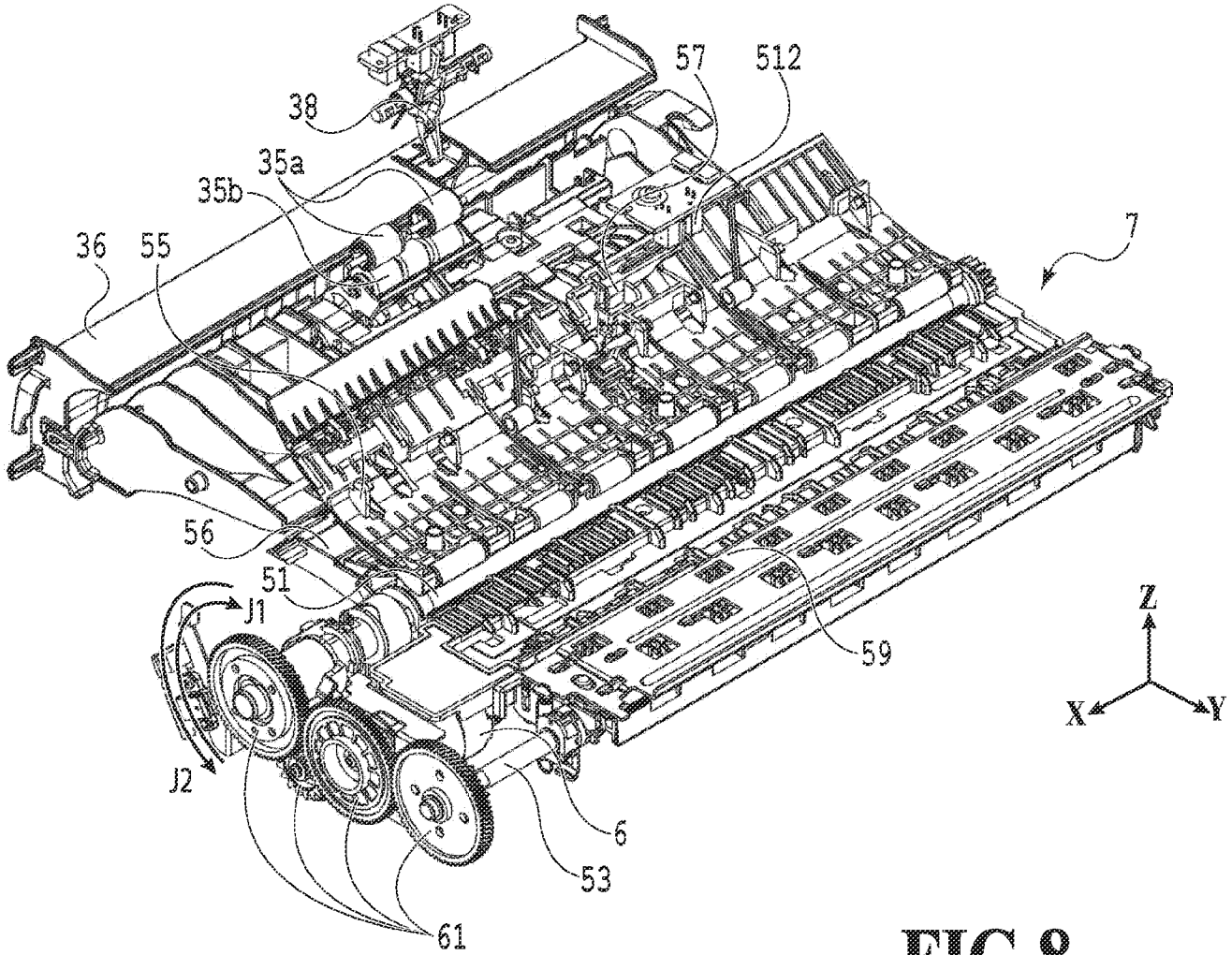
FIG. 8 is a perspective view illustrating a configuration of a conveyance unit of the printing apparatus according to the embodiment.

FIG. 8 is a perspective view illustrating a configuration of the conveyance unit. The conveyance roller 51 and the discharging roller 53 are drivingly coupled with each other through the driving motor 6 and the gear train 61. In a case where the driving motor 6 drives the conveyance roller 51 in a direction of an arrow J1 in FIG. 8, the conveyance roller 51 and the discharging roller 53 are rotated in a direction in which the conveyance roller 51 and the discharging roller 53 each convey the printing medium to a side downstream in the conveyance direction. On the other hand, in a case where the driving motor 6 drives the conveyance roller 51 in a direction of an arrow J2 in FIG. 8, the conveyance roller 51 and the discharging roller 53 are rotated in a direction in which the conveyance roller 51 and the discharging roller 53 each convey the printing medium to a side upstream with respect to the conveyance direction. The conveyance roller 51 and a driving force input gear of the cassette feeding unit 2 are drivingly coupled with each other by a not-illustrated gear train. In a case where the conveyance roller 51 is rotated in the direction of the arrow J1, the driving force input gear (not illustrated) of the cassette feeding unit 2 is rotated in the J1 direction in FIG. 8, that is, a direction in which a feeding operation is performed. In a case where the conveyance roller 51 is rotated in the direction of the arrow J2, the driving force input gear of the cassette feeding unit 2 is rotated in the J2 direction in FIG. 8, that is, a direction in which a feeding preparation operation is performed. A driving amount of the driving motor 6 is detected by a not-illustrated encoder, and it is possible to control a speed and the driving amount of the driving motor 6 by performing various types of control such as PID control.

Figure 9A:
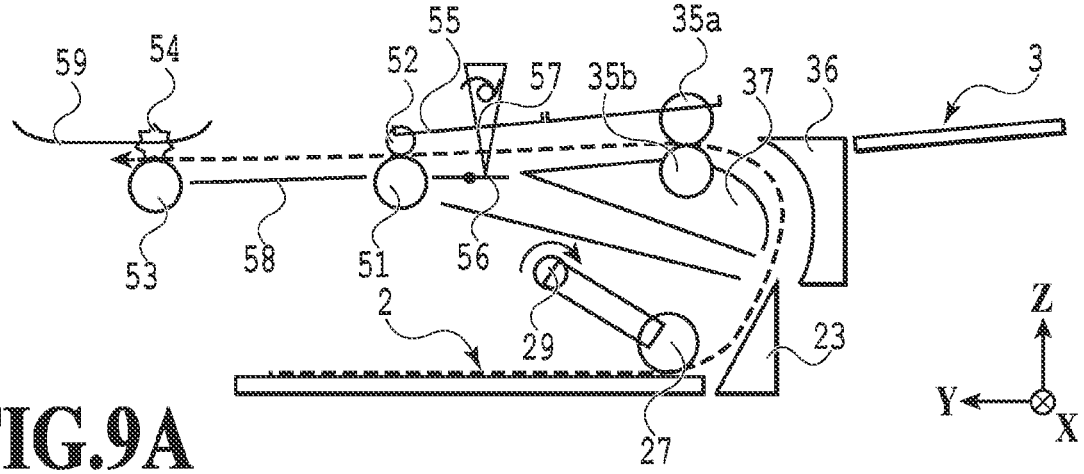
FIGS. 9A, 9B, and 9C are schematic diagrams describing conveyance of the printing medium in the conveyance unit.
Figure 9B:
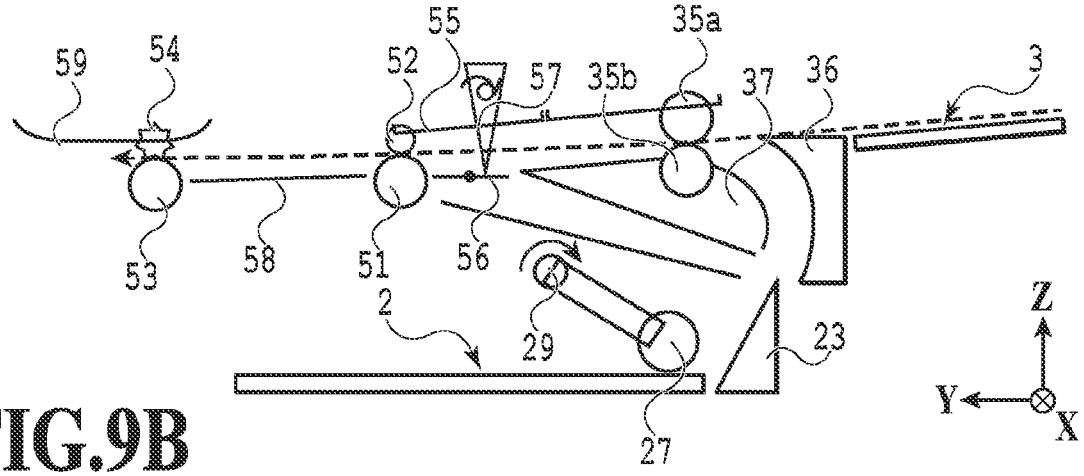
Figure 9C:
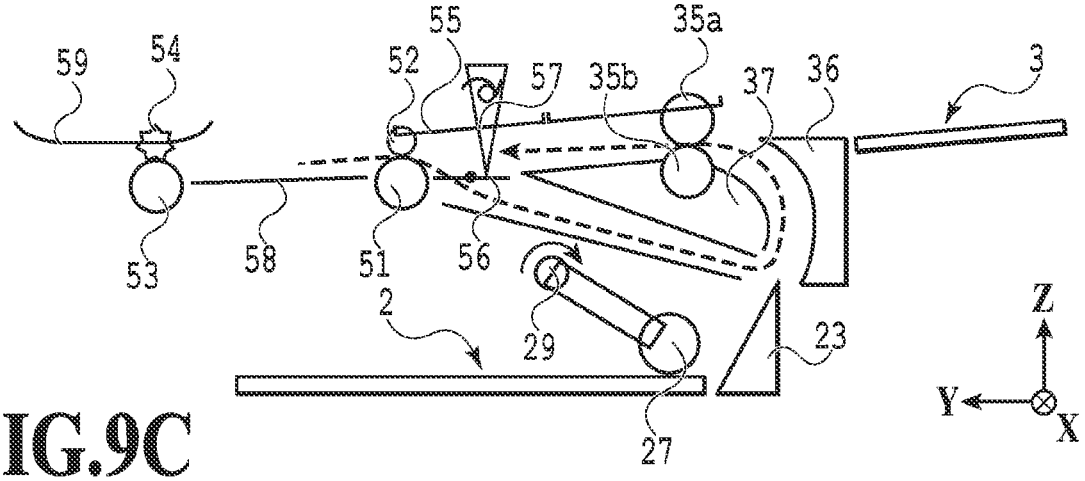

FIGS. 9A, 9B, and 9C are schematic diagrams describing conveyance of the printing medium in the conveyance unit.

FIG. 9A illustrates the conveyance in a case of the cassette feeding. The printing medium fed by the pickup roller 27 of the cassette feeding unit 2 passes through a conveyance route as indicated by a broken line arrow in FIG. 9A First, the printing medium that is separated and fed by the pickup roller 27 is guided by the inclined surface member 28 and the back side guide 36 and conveyed to the intermediate roller pair 35. Next, the printing medium is conveyed by the intermediate roller pair 35, guided by the pinch roller holder 55 and a conveyance guide portion 56, and fed to the conveyance roller 51.

FIG. 9B illustrates the conveyance in a case of the manual-feed feeding. As described later with reference to FIG. 14 and the like, the printing medium is set to the manual-feed feeding unit 3 while being nipped by the intermediate roller pair 35. From this state, the printing medium is fed to the conveyance roller 51 through a conveyance route as indicated by a broken line arrow in FIG. 9B by the intermediate roller pair 35.

An end portion detection sensor lever 57 is provided to the pinch roller holder 55 and detects the printing medium based on whether the end portion detection sensor lever 57 is in a state of blocking or not blocking the light onto an end portion detection sensor 512 (not illustrated in FIG. 9, see FIG. 11) (second detection). To be specific, with the end portion detection sensor lever 57 pivoting in a case where the printing medium passes through the conveyance path, positions of the tip and the rear end of the printing medium and whether there is the printing medium on the conveyance path are detected in accordance with the light-blocking state of the end portion detection sensor 512 depending on the pivoting position of the end portion detection sensor lever 57. With the detection of the tip position of the printing medium in the feeding operation and the detection of the rear end position in the printing operation or the discharging operation, it is possible to measure an actual length of the printing medium based on the driving amount of the driving motor 6 required to detect the tip position and the rear end position. Specifically, in a case where the end portion detection sensor lever 57 blocks the light onto the end portion detection sensor 512 (a detection ON state), a control unit 802 (FIG. 11) detects that there is no printing medium on the conveyance path. On the other hand, in a case where the light onto the end portion detection sensor 512 is not blocked (a detection OFF state), the control unit 802 detects that there is the printing medium on the conveyance path. Additionally, the control unit 802 detects the tip and rear end positions of the printing medium and whether there is the printing medium as described above in accordance with the change in the end portion detection sensor 512 between ON and OFF.

The printing medium fed to the conveyance roller 51 is conveyed to the printing unit 7 after executing a predetermined skew solving operation as needed, and the printing is performed on the printing medium by the printing head. A publicly-known operation can be used as the skew solving operation, and detailed description thereof is omitted. Along with the printing operation, the printing medium conveyed from the conveyance roller 51 is guided by the platen 58 and a spur base 59 and then reaches the discharging roller 53. During the printing medium printing operation, the conveyance roller 51, the discharging roller 53, or both the conveyance roller 51 and discharging roller 53 perform the conveyance operation, and after the printing operation is completed, the printing medium is discharged by the discharging roller 53 to the discharging tray 81.

FIG. 9C illustrates the conveyance in a case of the double-sided printing. In the double-sided printing, the discharging roller 53 and the conveyance roller 51 are driven to flip the printing medium over between the front and back sides on a conveyance route indicated by a broken line arrow in FIG. 9C and convey the printing medium to the intermediate roller pair 35. Thereafter, the printing medium is fed to the conveyance roller 51 by the intermediate roller pair 35, and as with the above descriptions, the printing and the discharging are performed after the skew solving operation and the like are executed.

(Conveyance Guide Portion)

Figure 10A:
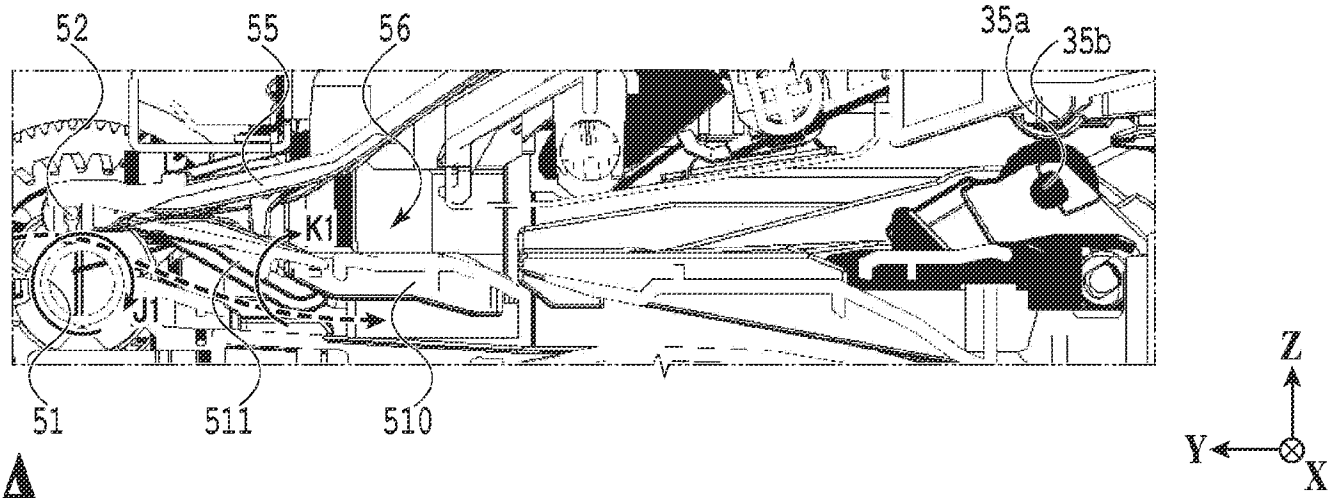
FIGS. 10A and 10B are cross-sectional views illustrating the vicinity of a conveyance guide portion of the printing apparatus according to the embodiment.
Figure 10B:
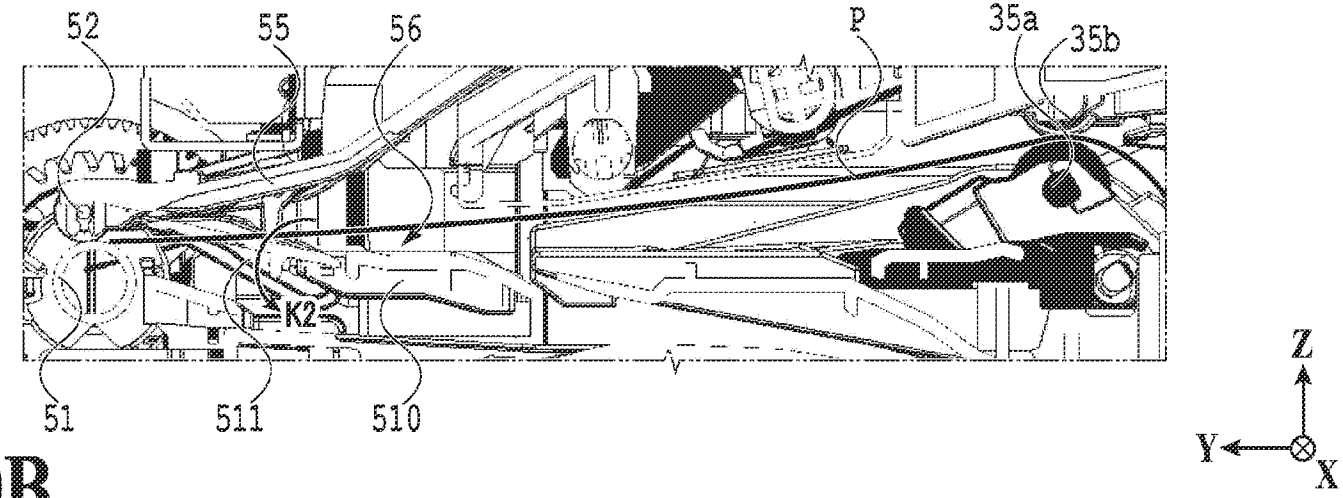

FIGS. 10A and 10B are cross-sectional views illustrating the vicinity of the conveyance guide portion 56 illustrated in FIGS. 9A to 9C. The conveyance guide portion 56 includes a guide base 510 and a guide flapper 511 pivotally provided. The guide flapper 511 is biased in a direction of an arrow K1 in FIG. 10A and is brought into contact with the pinch roller holder 55 by the biasing force. That is, the guide flapper 511 is in a position of blocking the conveyance path in the conveyance of the printing medium from the intermediate roller pair 35 to the conveyance roller 51. In a case where the printing medium is conveyed by the cassette feeding or the manual-feed feeding from the intermediate roller pair 35, the tip of the printing medium P is brought into contact with the guide flapper 511. Thereafter, along with the conveyance of the printing medium, the guide flapper pivots in a direction of an arrow K2 in FIG. 10B. That is, the biasing force to the guide flapper 511 in the K1 direction is set so as to support the self weight of the guide flapper 511 itself and also such that the guide flapper 511 pivots with the conveyance of the printing medium.

In the double-sided printing, the conveyance roller 51 is rotated in the J2 direction (see FIG. 8), and the printing medium passes through a conveyance route as indicated by a broken line arrow illustrated in FIG. 10A and is conveyed to the intermediate roller pair 35. In this process, the guide flapper 511 is biased to the pinch roller holder 55, and a lower surface of the guide flapper 511 forms the conveyance path. With the above configuration, it is possible to achieve all the cassette feeding, the manual-feed feeding, and the automatic double-sided printing with a simple configuration and simple control without operating the guide flapper 511 by another mechanism and complicated control.

(Control Unit and Operation by User)

Figure 11:
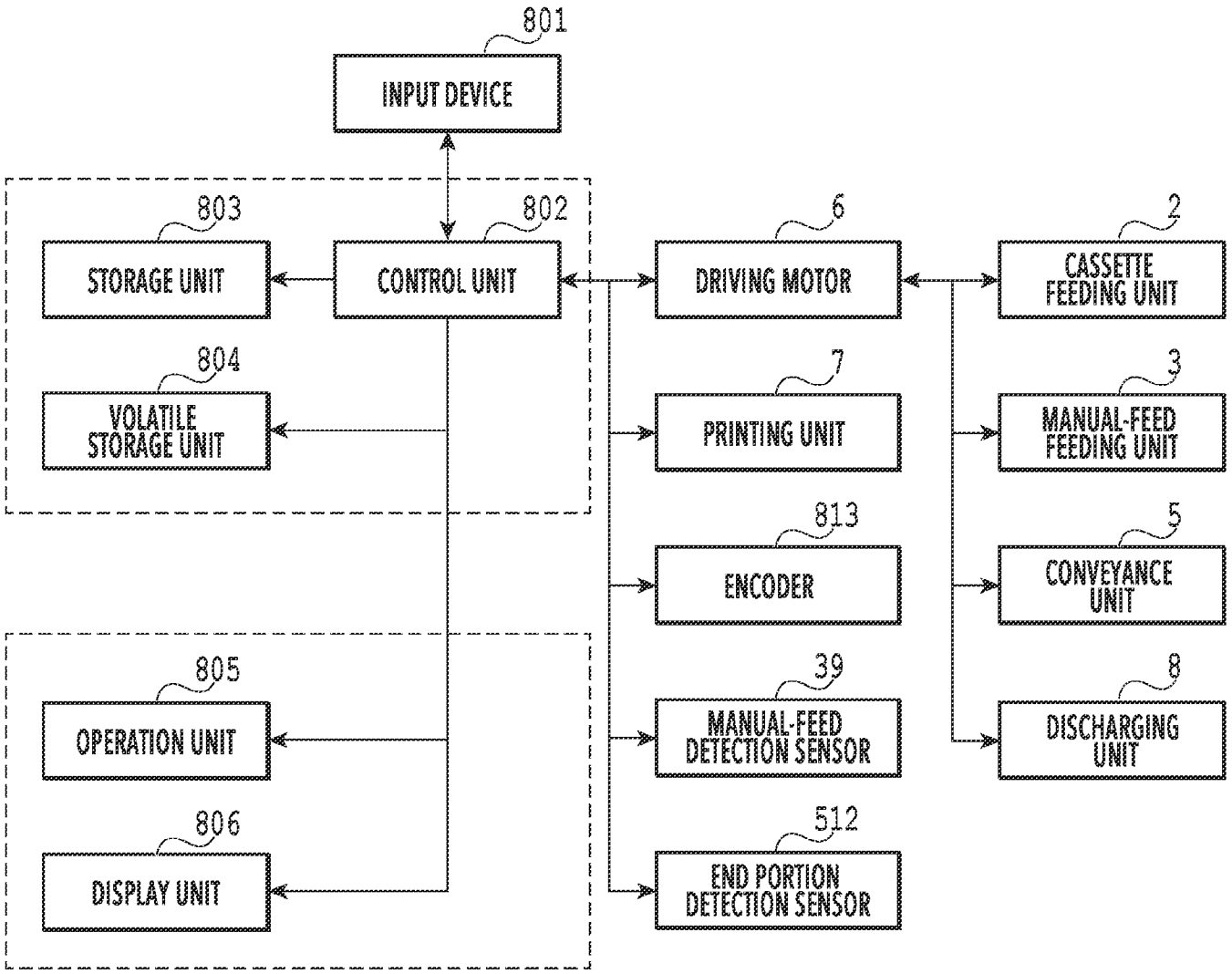
FIG. 11 is a block diagram illustrating a control configuration of the printing apparatus illustrated in FIG. 1.

FIG. 11 is a block diagram illustrating a control configuration of the printing apparatus illustrated in FIG. 1. In the printing apparatus of the present embodiment, the control unit 802 in the form of a CPU controls an operation of each unit. A storage unit 803 stores a program of processing to control the operation of each unit, which includes the processing described later with reference to FIGS. 12 and 13, and a volatile storage unit 804 is used as a working area in the above-described control processing. An operation unit 805 allows the user to perform required input and the like on the printing apparatus 1, and a display unit 806 displays an operation state of the apparatus and a notification to the user.

The control unit 802 rotates and drives a driving roller of each of the cassette feeding unit 2, the manual-feed feeding unit 3, the conveyance unit 5, and the discharging unit 8 through the driving control by the driving motor 6. Additionally, the control unit 802 performs the driving control of the roller in each of the above-described units particularly based on detection results from the manual-feed detection sensor 39 and the end portion detection sensor 512. Moreover, the control unit 802 controls the ink ejection from the printing head of the printing unit 7 based on the printing data and the like transmitted from an input device 801 and prints an image and the like on the printing medium. Furthermore, positional information on the driving motor 6 from an encoder 813 is also used to control the printing unit 7.

In the above configuration, the user instructs printing and copying through the input device 801 or the operation unit 805 such as a PC or a smartphone. The control unit 802 that receives this instruction stores printing job information according to the instruction and target size information into the storage unit 803.

Figure 12:
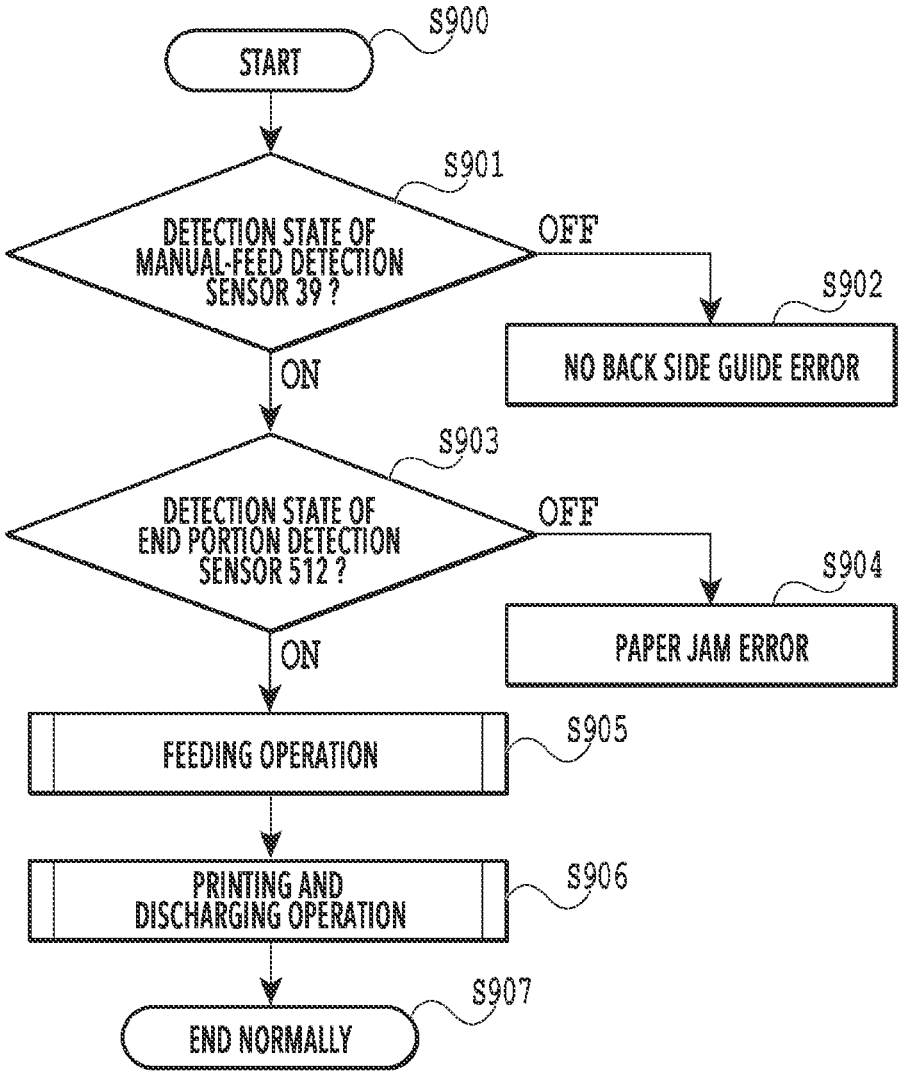
FIG. 12 is a flowchart illustrating control particularly related to detection of a printing medium conveyance state during cassette feeding in the printing apparatus according to the embodiment.

FIG. 12 is a flowchart illustrating control particularly related to detection of a printing medium conveyance state in the cassette feeding by the printing apparatus 1. A series of processing illustrated in the flowchart in FIG. 12 is performed with the control unit 802 deploying a program code stored in the storage unit 803 to the volatile storage unit 804 to execute. Alternatively, a part of or all the functions of the steps in FIG. 12 may be executed by hardware such as an ASIC or an electric circuit. Note that, a reference sign "S" in each description of the processing means that it is a step in the flowchart. Hereinafter, the same applies to the present specification.

In a case of the cassette feeding, first, whether the detection state of the manual-feed detection sensor 39 is ON or OFF is determined (S901). If the detection state is OFF, it is determined that the back side guide 36 is not mounted, and error information notifying of the determination result is displayed on the input device 801 or the display unit 806 to prompt the user to mount the back side guide (S902).

On the other hand, if the detection state of the manual-feed detection sensor 39 is ON (no printing medium), whether the detection state of the end portion detection sensor 512 is ON or OFF is determined (S903). If the detection state is OFF, that is, in a case where the end portion detection sensor 512 detects that there is the printing medium, error information notifying that the printing medium is left on the conveyance path (jammed) is displayed on the input device 801 or the display unit 806 (S904). Thus, the user is prompted to take out the printing medium (S904). If the detection state of the end portion detection sensor 512 is ON, it is determined that the back side guide 36 is mounted, and also no printing medium is left in the printing apparatus, in other words, it is a feedable state. Accordingly, the feeding operation (S905) is performed. Additionally, the printing and discharging operation (S906) is performed, and the processing flow ends (S907).

Figure 13B:
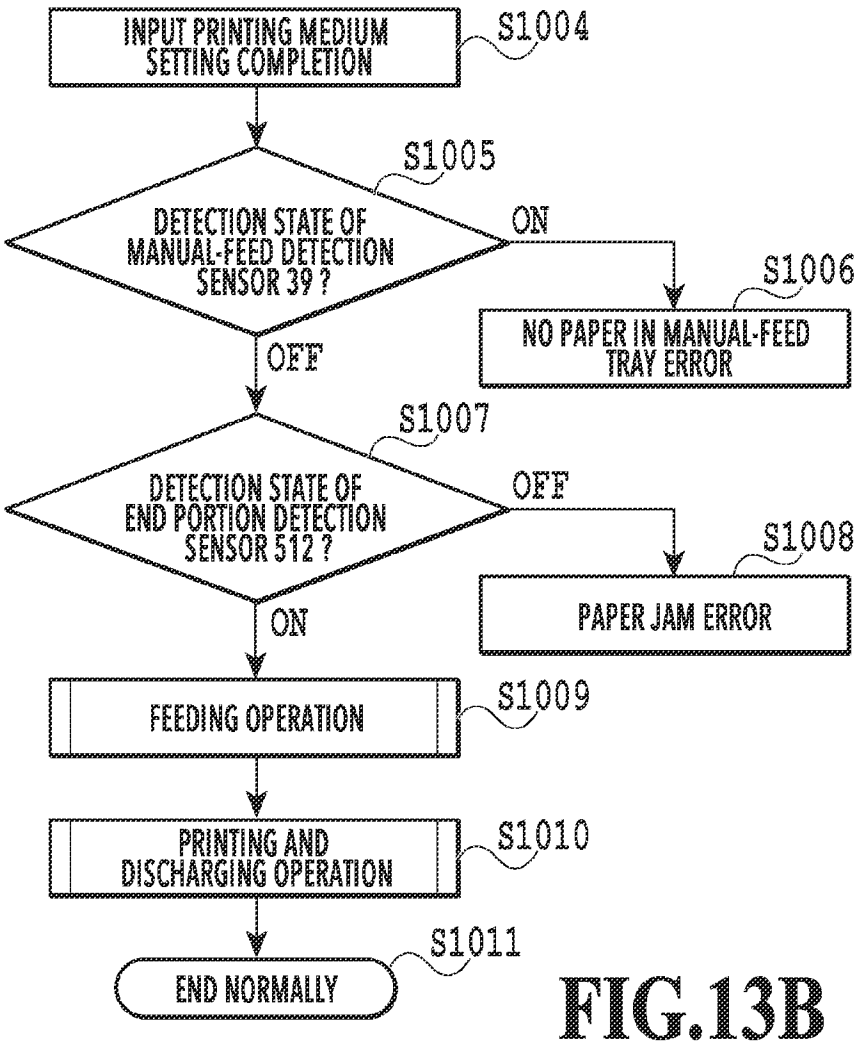
FIGS. 13A and 13B are flowcharts illustrating control particularly related to detection of a printing medium conveyance state during manual-feed feeding.
Figure 13A:
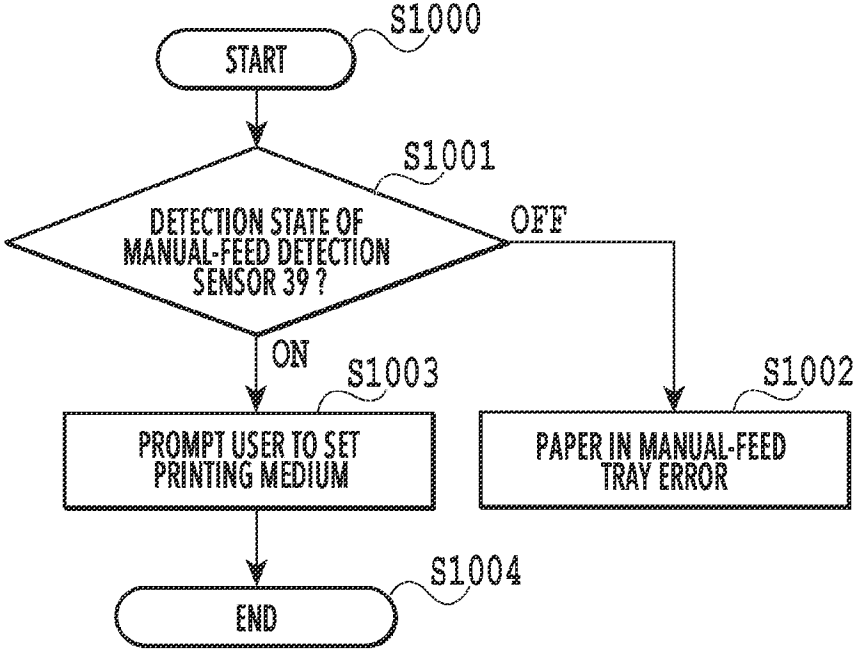

FIGS. 13A and 13B are flowcharts illustrating control particularly related to the detection of the printing medium conveyance state in the manual-feed feeding. A series of processing illustrated in the flowcharts in FIGS. 13A and 13B is performed with the control unit 802 deploying a program code stored in the storage unit 803 to the volatile storage unit 804 to execute. Alternatively, a part of or all the functions of the steps in FIGS. 13A and 13B may be executed by hardware such as an ASIC or an electric circuit.

In a case of the manual-feed feeding, once a printing command is received from the user in a manual-feed mode, as illustrated in FIG. 13A, whether the manual-feed detection sensor 39 is in the ON state or the OFF state is determined (S1001). If the control unit 802 determines that the detection state is OFF, an error notifying that there is paper on the manual-feed tray is displayed on the input device 801 or the display unit 806 to prompt the user to take out the printing medium (S1002). In this case, as described above, since it is impossible to confirm that the back side guide 36 is mounted in a case where the manual-feed detection sensor 39 is OFF, it is determined as the error, and the above-described processing is executed (S1002) without proceeding to the next processing.

On the other hand, if the detection state of the manual-feed detection sensor 39 is ON, it is determined that there is no printing medium in the manual-feed feeding unit 3, and a notification to prompt the user to set the printing medium is displayed (S1003). With this, an instruction to press an "OK" button (not illustrated) displayed on the input device 801 or the display unit 806 after the setting is displayed on the input device 801 or the display unit 806 (S1003). In response to this, once the user sets the printing medium to the manual-feed feeding unit 3 and presses the "OK" button displayed on the display unit 806, the next processing is started (S1004).

As illustrated in FIG. 13B, in this processing, first, whether the detection state of the manual-feed detection sensor 39 is the ON state or the OFF state is determined (S1005). If the detection state is ON, it is determined that there is no printing medium in the manual-feed feeding unit 3, and an error notifying that there is no printing medium on the manual-feed stacking unit 31 is displayed on the input device 801 or the display unit 806 (S1006) to prompt the user to set the printing medium.

On the other hand, if the detection state of the manual-feed detection sensor 39 is OFF, whether the detection state of the end portion detection sensor 512 is the ON state or the OFF state is determined (S1007). In this process, if the detection state of the end portion detection sensor 512 is OFF, a paper Jam error notifying that the printing medium is inserted too deep is displayed to prompt the user to set the printing medium again (S1008).

If the detection state of the end portion detection sensor 512 is ON, it is possible to determine that the printing medium is properly set on the manual-feed stacking unit 31. In other words, it is determined that the printing medium is nipped by the intermediate roller pair 35 but is not nipped by the conveyance roller 51 and the pinch roller 52 and not put in contact with this pair of rollers. That is, it is determined that it is in the printing medium feedable state, the feeding operation (S1009) and the printing and discharging operation (S1010) are performed, and the processing flow ends (S1011).

With the above conveyance path configuration and control processing, it is possible to detect the attachment state of the back side guide 36 and whether the printing medium is on the manual-feed stacking unit 31 only with the one pair of the manual-feed detection sensor lever 38 and the manual-feed detection sensor 39. Thus, it is possible to determine whether the feeding from the frequently used cassette can be executed and also to determine whether the feeding from the manual-feed feeding can be executed without causing an increase in cost.

Figure 14:
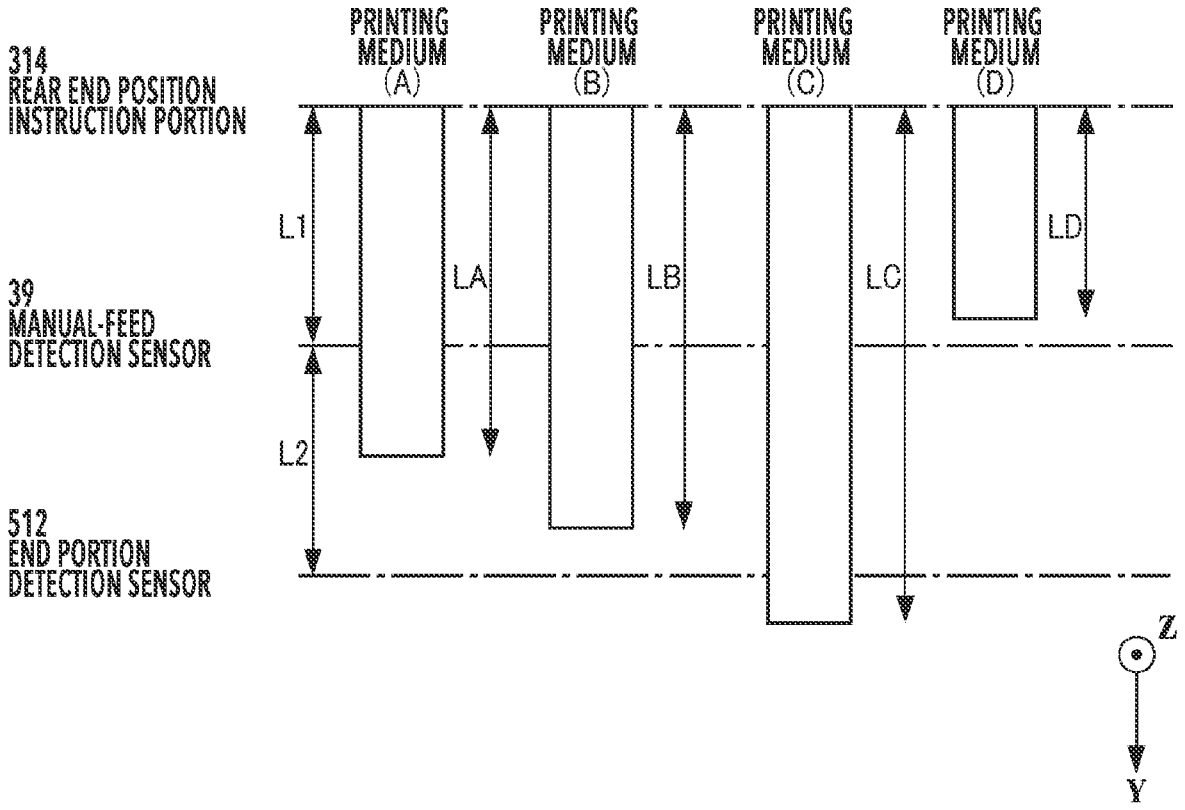
FIG. 14 is a schematic diagram describing processing of confirming a setting position of the printing medium in the manual-feed feeding according to an embodiment of the present invention.

FIG. 14 is a schematic diagram describing processing to confirm a setting position of the printing medium in the manual-feed feeding according to an embodiment of the present invention, and FIG. 14 corresponds to the processing illustrated in FIG. 13B.

In FIG. 14, a distance from the rear end position instruction portion 314 to the manual-feed detection sensor 39 is L1, and a distance from the manual-feed detection sensor 39 (a position of nipping by the intermediate roller pair 35) to the end portion detection sensor 512 (a position of nipping by the conveyance roller 51 and the pinch roller 52) is L2. Additionally, printing media (A), (B), (C), and (D) are printing media having different lengths, and the respective lengths are LA, LB, LC, and LD. The printing media (A) and (B) each have a printing medium length greater than L1 and smaller than L1+L2. In this case, while the printing medium is being set, the detection state of the manual-feed detection sensor 39 is OFF (a state of being nipped by the intermediate roller pair 35), and the detection state of the end portion detection sensor 512 is ON (a state of not being nipped by the conveyance roller 51 and the pinch roller 52). That is, in the feeding for the printing, the printing media (A) and (B) are nipped by the intermediate roller pair 35 but do not reach the nipping unit of the conveyance roller 51 and the pinch roller 52. Thus, it is possible to apply sufficient conveyance force to the printing medium during the feeding and to suppress the conveyance malfunction. This state corresponds to the detection that the control unit 802 made as ON in step S1007 in FIG. 13B as described above.

The printing medium (C) has a printing medium length greater than L1+L2; accordingly, the detection state of the end portion detection sensor 512 is OFF (a state of being nipped by the conveyance roller 51 and the pinch roller 52), and it is determined that the printing medium is inserted too deep. This state corresponds to the detection that the control unit 802 made as OFF in step S1007 in FIG. 13B as described above.

The printing medium (D) has a printing medium length smaller than L1; accordingly, the detection state of the manual-feed detection sensor 39 is ON (a state of not being nipped by the intermediate roller pair 35), and it is determined that the printing medium is not set on the manual-feed stacking unit 31.

As described above, according to the embodiment of the present invention, in the feeding of the printing medium in a proper size in the manual-feed feeding, for example, it is possible to apply sufficient conveyance force to the printing medium even if it is thick paper, and thus it is possible to suppress the conveyance malfunction in the feeding.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)$^{T}$M) a flash memory device, a memory card, and the like.

According to the above configuration, it is possible to perform feeding without causing a conveyance malfunction regardless of a type of a printing medium in manual-feed feeding by a printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent mechanisms and functions.

This application claims the benefit of Japanese Patent Application No. 2022-161420 filed Oct. 6, 2022, which is hereby incorporated by reference herein in its entirety.

What is claimed is:

1. A printing apparatus comprising:

a first conveyance path on which a printing medium from a manual-feed stacking unit is conveyed in a conveyance direction;

a second conveyance path converging with the first conveyance path at a converging section and on which a printing medium from a cassette is conveyed;

a first conveyance roller pair provided downstream of the converging section in the conveyance direction of the first conveyance path and configured to nip and convey a printing medium;

a first detection unit configured to detect a printing medium stacked on the manual-feed stacking unit;

a second conveyance roller pair provided on a side downstream in the conveyance direction of the first conveyance roller pair on the first conveyance path and configured to nip and convey a printing medium;

a printing unit provided on a side downstream in the conveyance direction of the second conveyance roller pair and configured to print an image on a printing medium;

a second detection unit arranged between the first conveyance roller pair and the second conveyance roller pair and configured to detect a printing medium;

a third conveyance path on which a printing medium is conveyed in an opposite direction opposite to the conveyance direction and in which a printing medium is flipped between front and back surfaces in the conveyance in the third conveyance path, which converges with the first conveyance path;

a flapper configured to selectively allow a printing medium which is conveyed in the conveyance direction by the first conveyance roller pair to pass to the second conveyance roller pair and allow a printing medium which is conveyed in the opposite direction by the second conveyance roller to pass to the third conveyance path, and a control unit configured to perform control to start feeding of a printing medium to the printing unit by the first conveyance roller pair in a case in which the first detection unit detects the printing medium but the second detection unit does not detect the printing medium.

2. The printing apparatus according to claim 1, wherein in the second conveyance path, a printing medium is U-turned and conveyed.

3. The printing apparatus according to claim 1, wherein the control unit allows the first conveyance roller pair to convey a printing medium from the cassette to the first conveyance path.

4. The printing apparatus according to claim 1, further comprising:

a guide portion forming a part of the first conveyance path, wherein the guide portion can be attached to and detached from a main body of the printing apparatus.

5. The printing apparatus according to claim 4, wherein the first detection unit can perform the detection in a first detection state in which no printing medium is in the first conveyance path and also the guide portion is mounted are detected and in a second detection state in which a printing medium is in the first conveyance path or the guide portion is not mounted is detected, and in a case of the detection in the second detection state, the first detection unit detects that a fed printing medium is nipped by the first conveyance roller pair.

6. The printing apparatus according to claim 5, wherein the second detection unit can perform the detection in a third detection state in which no printing medium is in the first conveyance path is detected and in a fourth detection state in which a printing medium is in the first conveyance path is detected, and in a case of the detection in the fourth detection state, the second detection unit detects that a printing medium is nipped by the second conveyance roller pair.

7. The printing apparatus according to claim 1, wherein one roller of the first conveyance roller pair is supported at an end portion of a pivotable arm, and in a case in which a printing medium is inserted in the first conveyance path, the arm pivots in a direction in which a force to nip the printing medium by the first conveyance roller pair is reduced.

8. The printing apparatus according to claim 1, wherein the flapper is biased such that conveyance in the third conveyance path is performed by the second conveyance roller pair, and the flapper pivots such that conveyance in the first conveyance path is performed by the second conveyance roller pair by being put in contact with a printing medium conveyed from the first conveyance path.

9. The printing apparatus according to claim 1, wherein the stacking unit includes an index indicating a position of a rear end of a printing medium.

10. A control method of a printing apparatus which comprises:

a first conveyance path on which a printing medium from a manual-feed stacking unit is conveyed in a conveyance direction;

a second conveyance path converging with the first conveyance path at a converging section and on which a printing medium from a cassette is conveyed;

a first conveyance roller pair provided downstream of the converging section in the conveyance direction of the first conveyance path and configured to nip and convey a printing medium;

a first detection unit configured to detect a printing medium stacked on the manual-feed stacking unit;

a second conveyance roller pair provided on a side downstream in the conveyance direction of the first conveyance roller pair on the first conveyance path and configured to nip and convey a printing medium;

a printing unit provided on a side downstream in the conveyance direction of the second conveyance roller pair and configured to print an image on a printing medium;

a second detection unit arranged between the first conveyance roller pair and the second conveyance roller pair and configured to detect a printing medium;

a third conveyance path on which a printing medium is conveyed in an opposite direction opposite to the conveyance direction and in which a printing medium is flipped between front and back surfaces in the conveyance in the third conveyance path, which converges with the first conveyance path; and a flapper configured to selectively allow a printing medium which is conveyed in the conveyance direction by the first conveyance roller pair to pass to the second conveyance roller pair and allow a printing medium which is conveyed in the opposite direction by the second conveyance roller to pass to the third conveyance path, wherein control is performed to start feeding of a printing medium to the printing unit by the first conveyance roller pair in a case in which the first detection unit detects the printing medium but the second detection unit does not detect the printing medium.

* * * * *